US005658049A

United States Patent [19]

Adams et al.

[11] Patent Number: 5,658,049

[45] Date of Patent: Aug. 19, 1997

[54] SEPARABLE RECLINER CHAIR ASSEMBLY

[75] Inventors: R. Craig Adams; Stephen C. Luensman; Orville T. Schultz; Todd A. Yoder, all of Dublin, Ga.

[73] Assignee: Flexsteel Industries, Inc.

[21] Appl. No.: 593,906

[22] Filed: Jan. 30, 1996

Related U.S. Application Data

[60] Provisional application No. 60/005,625, Oct. 19, 1995.

[51] Int. Cl. [6] ..... A47C 7/00

[52] U.S. Cl. ..... 297/440.23; 297/452.52; 297/452.54; 297/440.16

[58] Field of Search ..... 297/452.52, 452.54, 297/440.16, 440.14, 440.1, 440.21, 440.23, 343, 85, 68, 69, 354.13, 354.12, 90, 423.26, 411.27, 411.26

[56] References Cited

U.S. PATENT DOCUMENTS

| | | | |
|---|---|---|---|
| 611,049 | 9/1898 | Allen | 297/90 |
| 939,827 | 11/1909 | Greilick | 297/423.26 X |
| 2,575,221 | 11/1951 | Horner et al. | 297/440.16 |
| 3,774,966 | 11/1973 | Faulkner et al. | 297/440.23 |
| 4,082,355 | 4/1978 | Knabusch et al. . | |
| 4,492,409 | 1/1985 | Laird . | |
| 5,135,284 | 8/1992 | Crum . | |
| 5,156,442 | 10/1992 | Courtois . | |
| 5,184,871 | 2/1993 | LaPointe et al. . | |
| 5,253,923 | 10/1993 | Gootee . | |
| 5,269,497 | 12/1993 | Barth . | |
| 5,269,589 | 12/1993 | Brothers et al. . | |
| 5,288,126 | 2/1994 | Saul et al. | 297/440.16 X |

FOREIGN PATENT DOCUMENTS

| | | | |
|---|---|---|---|
| 187388 | 1/1937 | Switzerland | 297/440.23 |

*Primary Examiner*—Milton Nelson, Jr.
*Attorney, Agent, or Firm*—Lee, Mann, Smith, McWilliams, Sweeney & Ohlson

[57] ABSTRACT

An improved seating product assembly having detachable arms and a detachable back, and having an improved spring system for a more comfortable sitting. The improved seating product assembly includes an all metal unitized seat spring and frame assembly having insert brackets attached to side potions thereof. Corresponding slide brackets are attached to the seating product arms. The insert brackets are inserted into the slide brackets as the arms are placed downwardly adjacent each side of the seating product, thereby attaching the arms to the unitized seat spring and frame assembly. Similarly, rear slide brackets are attached to the seat back and corresponding insert brackets are mounted to the rear of the seating product assembly. The slide brackets of the seat back are inserted into the rear slide brackets as the seat back is placed downwardly adjacent the back of the seating product, thereby attaching the seat back to the seating product assembly. Additionally, the seating product assembly includes an improved spring system incorporated into the tubular unitized seat spring and frame assembly. A plurality of springs are riveted across the tubular unitized seat spring and frame assembly. Each spring includes a pair of V-arcs and a central portion. This spring configuration increases the range of vertical deflection of each spring, thus providing support without loss of the desired sitting feel.

10 Claims, 7 Drawing Sheets

SEPARABLE RECLINER CHAIR ASSEMBLY

BACKGROUND OF THE INVENTION

This application claims priority based on provisional application Ser. No. 06/005,625 filed Oct. 19, 1995.

The present invention relates generally to articles of furniture and, more particularly, to an improved chair having detachable arms, detachable back and an improved unitized seat spring and frame assembly.

Reclining chairs are known to be big and bulky articles of furniture. Because of their size, these chairs can be difficult, and sometimes expensive to ship and to store. This creates a need for more efficient storage and shipment of these particular types of chairs.

SUMMARY OF THE INVENTION

Accordingly, it is a primary object of the present invention to provide an improved chair having separable features which includes a unitized seat spring and frame assembly structure which allows for the detachment of the arms and back from the chair structure. The detaching arm and back features of the chair allow for easy and compact storage of the chair and its component parts. The unitized seat spring and frame assembly structure also includes integrated seat springs which allow for increased vertical deflection of attached seat springs, thereby providing for increased load carrying capacity of the spring unit.

In accordance with a preferred embodiment, an improved separable chair having detachable arms and back and improved load carrying capacity is disclosed. The arms and back detach, and easily reattach without screws, bolts, nuts or tools. The removing of the recliner arms and back enables the entire chair to be packaged into two separate cartons, each of which comes within a size limitation for postal and package service shipment and residential delivery.

Each chair uses an improved spring system. The spring system includes a heavy steel perimeter frame and a plurality of attached springs between the frame members. This improved spring unit, frame, and chair assembly facilitates the inclusion of four welded, or bolted-on "male" mounting posts designed to receive corresponding "female" mounting brackets which are bolted to the arms and back of the chair. The unitized seat spring and frame assembly also has spaced apart spring steel straps extending from the front to the rear portion of the frame with each strap containing at least one V-arc. The use of the V-arc near the rear frame portion, or near both the rear and front frame portions, allows increased vertical deflection of the spring and therefore provides a softer feel.

This seat arrangement and the separable arms and back, while primarily designed for a recliner chair, would also have advantages in connection with other chairs with backs and arms, such as non-reclining chairs, sofas or love seats.

This improved chair or seating product allows for delivery of the chair components, direct from the manufacturer to the consumer, without costly warehousing, rehandling and reshipping.

The improved chair can be disassembled into separate parts which can be tightly packaged for shipment and residence delivery, and can be quickly and easily reassembled by an average consumer without tools.

Further objects and advantages of the present invention will be apparent from the following description, reference being made to the accompanying drawings wherein the preferred embodiments of the present invention are clearly shown.

DESCRIPTION OF THE PREFERRED EMBODIMENT

Figure 1:
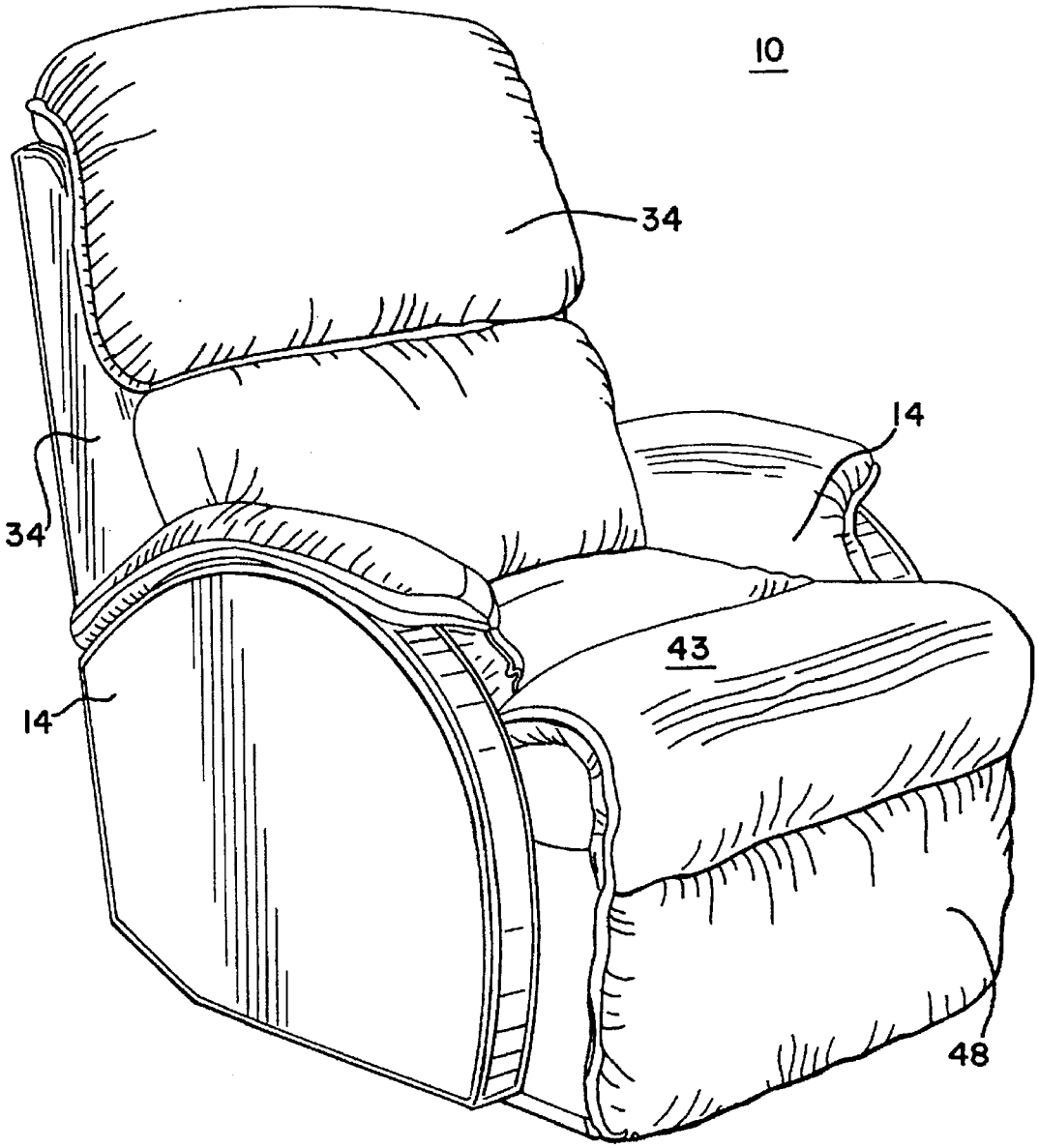
FIG. 1 is a perspective view of the chair.
Figure 2B:
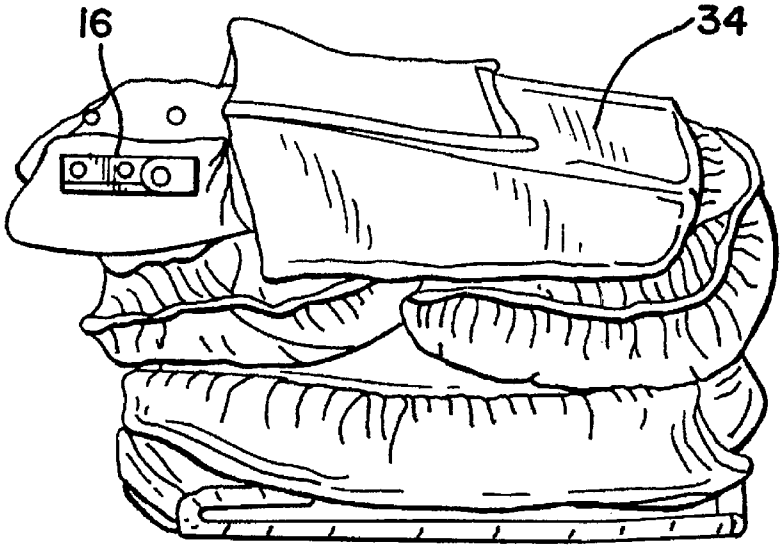
FIG. 2B is a pictorial view of the detachable arms and back removed showing the removed back positioned atop both removed arms.
Figure 2A:
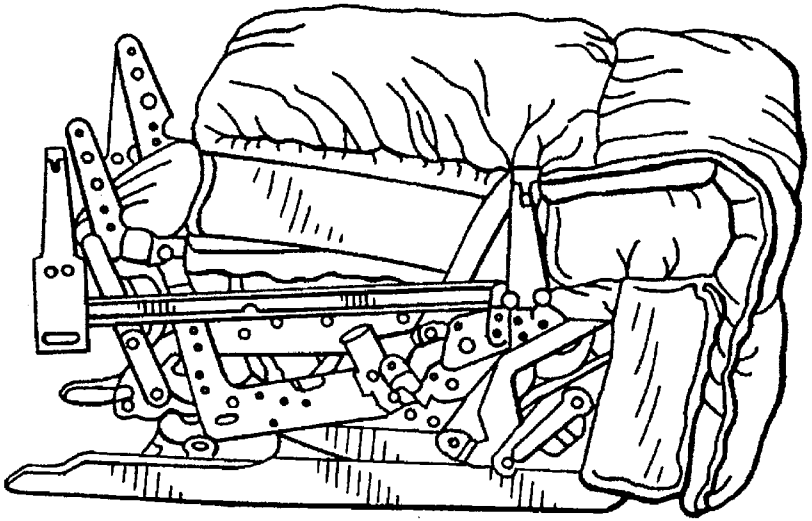
FIG. 2A is a pictorial view of a chair with the detachable arms and back removed.

With particular references to the drawings, an exemplary separable chair or seating product 10 is shown to include a chair base 44, an upholstered seat member 43, a unitized seat spring and frame assembly 22 having springs 28, a pair of upholstered side arms 14 adapted to be releasably secured to the unitized seat spring and frame assembly 22, a recliner mechanism base 46, a seat back 34 adapted to be releasably sectored to the recliner mechanism base 46 and an extensible foot rest 48. As will be described hereinafter, an attaching and detaching arrangement is incorporated into the chair or seating product 10 for permitting the side arms 14 and seat back 34 to be releasably detached from the chair 10 for convenient storage and shipment (FIGS. 2A and 2B).

The chair also includes an improved seat spring system (FIGS. 4 and 5) for improved manufacturing, increased durability and a more comfortable sitting. This type of spring arrangement is disclosed in U.S. Pat. No. 5,269,497, which is incorporated by reference. While the embodiments to be described hereinafter illustrate the improved detachment mechanism and the spring system incorporated into a recliner chair, it will be appreciated that the present invention can also be used with other suitable articles of furniture such as nonreclining chairs, sofas, love seats and the like.

Figure 5:
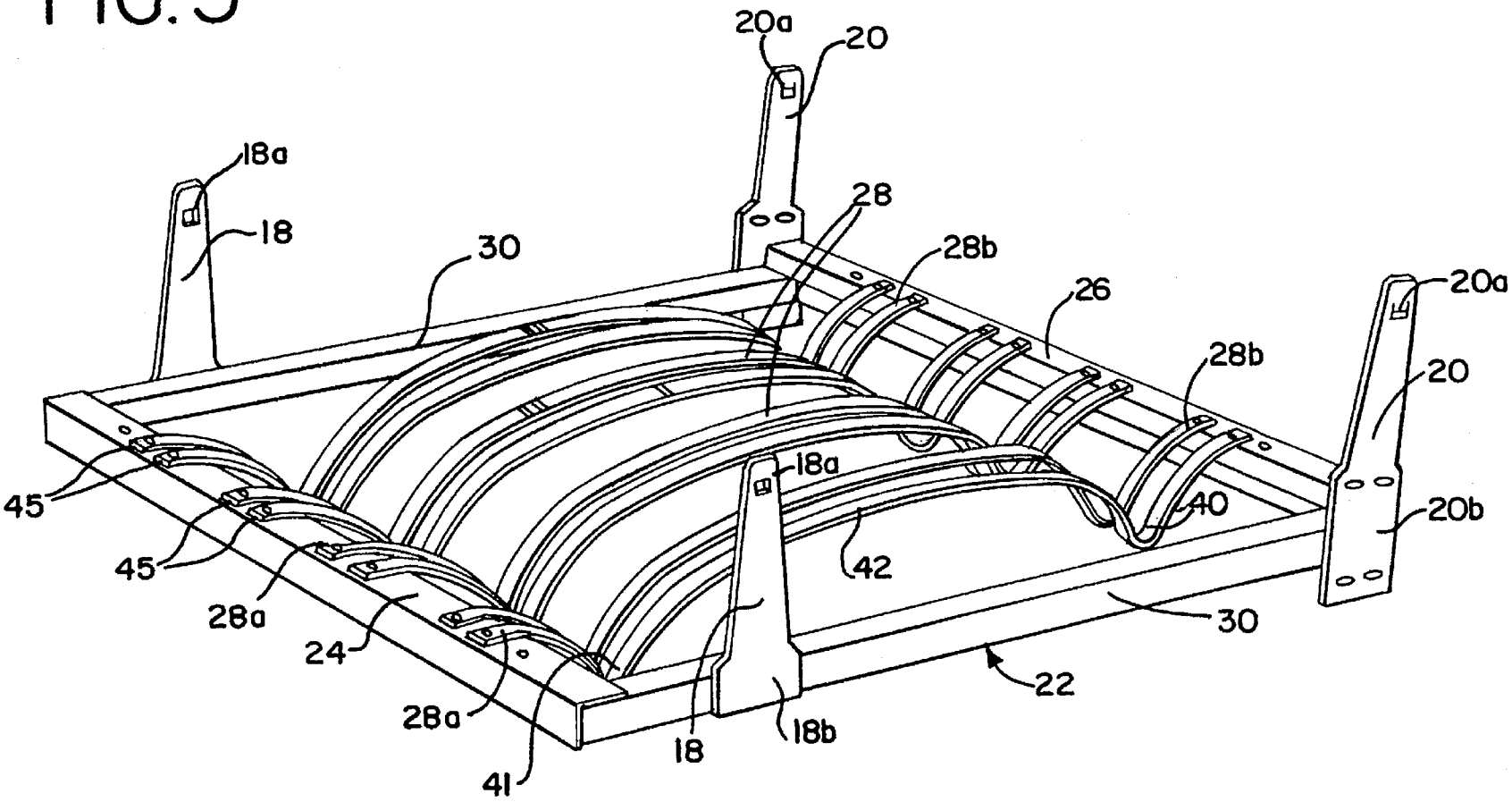
FIG. 5 is a perspective view of the unitized seat spring and frame assembly.

As seen in FIG. 5, the unitized seat spring and frame assembly 22 has a front frame member 24, a rear frame member 26 and a pair of side frame member 30. Attached to each side frame member 30 is a pair of tapered insert brackets 18 and 20. The front insert brackets 18 are mounted toward the front of the side frame member 30 at mounting portion **18*b*. The rear insert brackets 20 are mounted at the rear end of the side frame members 30 using enlarged mounting portion 20*b***.

The unitized seat spring and frame assembly 22 is made of a square metal channel, angle or tubular construction. In the preferred embodiment tubular construction is used. It is important that the outside potions of the side frame members 30 have a relatively smooth flat surface for facilitating attachment, i.e., welding, bolting, of the planar insert brackets 18 and 20 to the side frame members 30. Welding is used in the preferred embodiment. It is also important to have a flat surface on the top of the front and rear frame members 24 and 26 for facilitating attachment, i.e., riveting, the springs 28 to the top of the front portion of the unitized seat spring and frame assembly 22. Additional advantages to the use of an all metal unitized seat spring and frame assembly is the resistance to warping and flexing of the prior art wood flames.

Arms 14, in the preferred embodiment use plywood arm frames, having advantages of light weight, dimensional stability and ease of fastening of upholstery. The loads on the arms are much different than on the seating product frame itself. Plywood is not generally adaptable to the main frame, solid wood is used in the prior art. The arms, however, are readily adaptable to the use of plywood, thus the invention permits use of materials to take maximum advantage of their strength and stability properties.

Similarly, wood frames can be used for the back 34 of the chair or seating product. As with the arms, upholstering and reupholstering using staples or tacks to hold fabric or leather to the back frame is more easily adapted to use of a wood frame. By comparison, there are fewer ways to attach upholstery to the all metal unitized seat frame assembly 22 because staples or nails cannot easily be applied to metal. In this way, the use of detachable arms 14 and back provide for improved aesthetics giving greater flexibility in adapting different upholstery styles to a given base. Further, it is also feasible to remove an arm 14 or back 34 for ease of reupholstery or for warranty services. The invention also makes feasible the economic changing of a style of arm or style of back by substituting another standardized mounting pair of arms or back having a different shape and padding, but still mating with or mountable on the respective brackets 18, 20 for the arms and brackets 32 for the back.

The mounting portions **18*b* and 20*b* serve to hold brackets 18 and 20 on side frame members 30 and to distribute loads applied on the arms 14 to the frame members 30 without compromising the integrity of the bracket mounting. In this regard it will be noted the mounting portion 20*b* is considerably larger than mounting portion 18*b*** to optimize strength and frame geometry and to take advantage of the space and structural advantages present when using the spring arrangement disclosed.

The use of the steel perimeter frame in home furnishings is important in enabling the adaptation of a chair or other seating item such as a sofa or love seat to the use of removable arms. In ordinary chairs with standard spring arrangements traditional flames of wood are used. The steel perimeter frame interconnects front and rear frame members 24 and 26 with side portions 30. These enable a space saving structure, heretofore not a consideration in home furnishings, which has high strength to resist loads in different directions, such as sidewards loads on the arms, while providing ease of fabrication and mounting of brackets 18 and 20. The added strength is particularly important in a recliner chair, or the like, where considerable stress is often placed on the arms in order to operate certain mechanisms or the enter or exit the chair.

Figure 9:
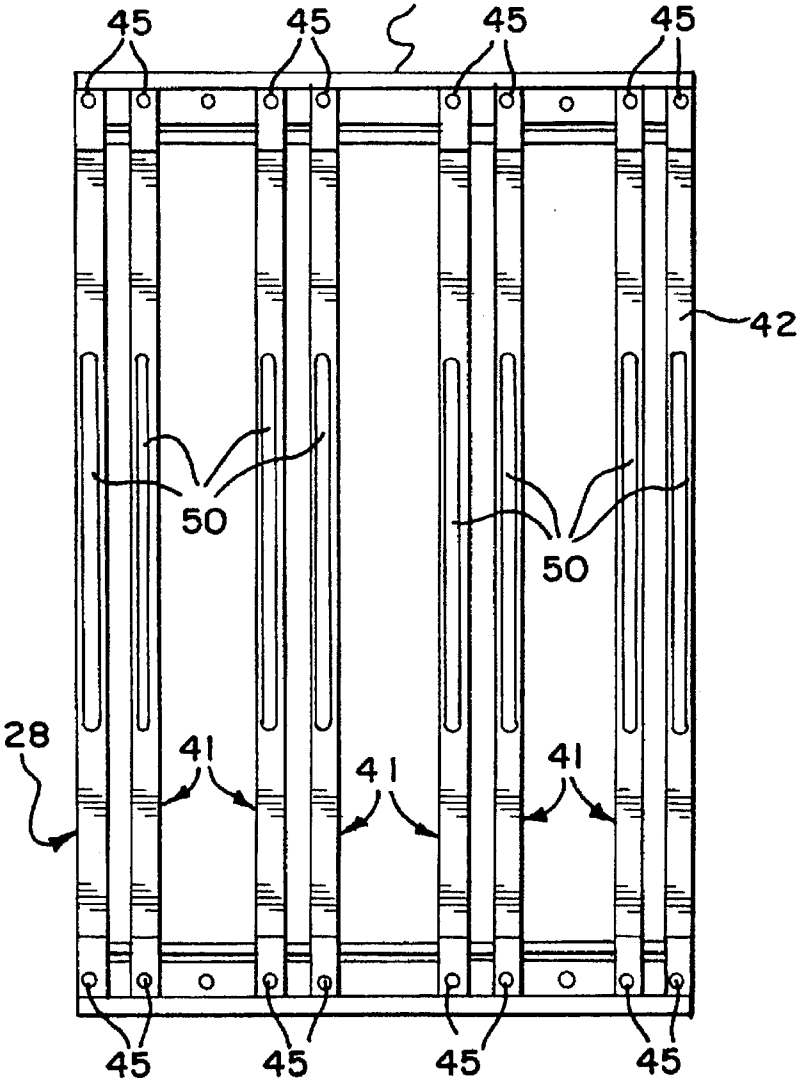
FIG. 9 is a top plan view of the seat springs.

Mounted between the front frame member 24 and rear frame member 26 are a plurality of seat springs 28. Each of the springs 28 has a rear end portion **28*b* that is affixed to the rear frame member 26 and a front end member 28*a* that is affixed to the front frame member 24. Attachment of the springs 28 can be done in any suitable manner, such as by the use of rivets 45. Formed near the rear spring portion 28*b* is first V-arc 40. Similarly, formed near the front end spring portion 28*a* is a second V-arc 41. Between V-arcs 40 and 41 is a central portion 42 that is formed with a crown and may be provided with a strengthening portion 50 (As seen in FIG. 9) formed from the same material that is used in forming the springs 28. The strengthening portion 50 assists in spreading the load in each spring member 28 over the length of the member 28. Also, the strengthening portion 50 provides some additional resistance to vertical movement without limiting the downward travel of the spring member 28. This design of the central portion 42 thus helps to increase the range of vertical deflection of each spring member 28**, thus providing support without loss of the desired sitting feel.

Figure 3:
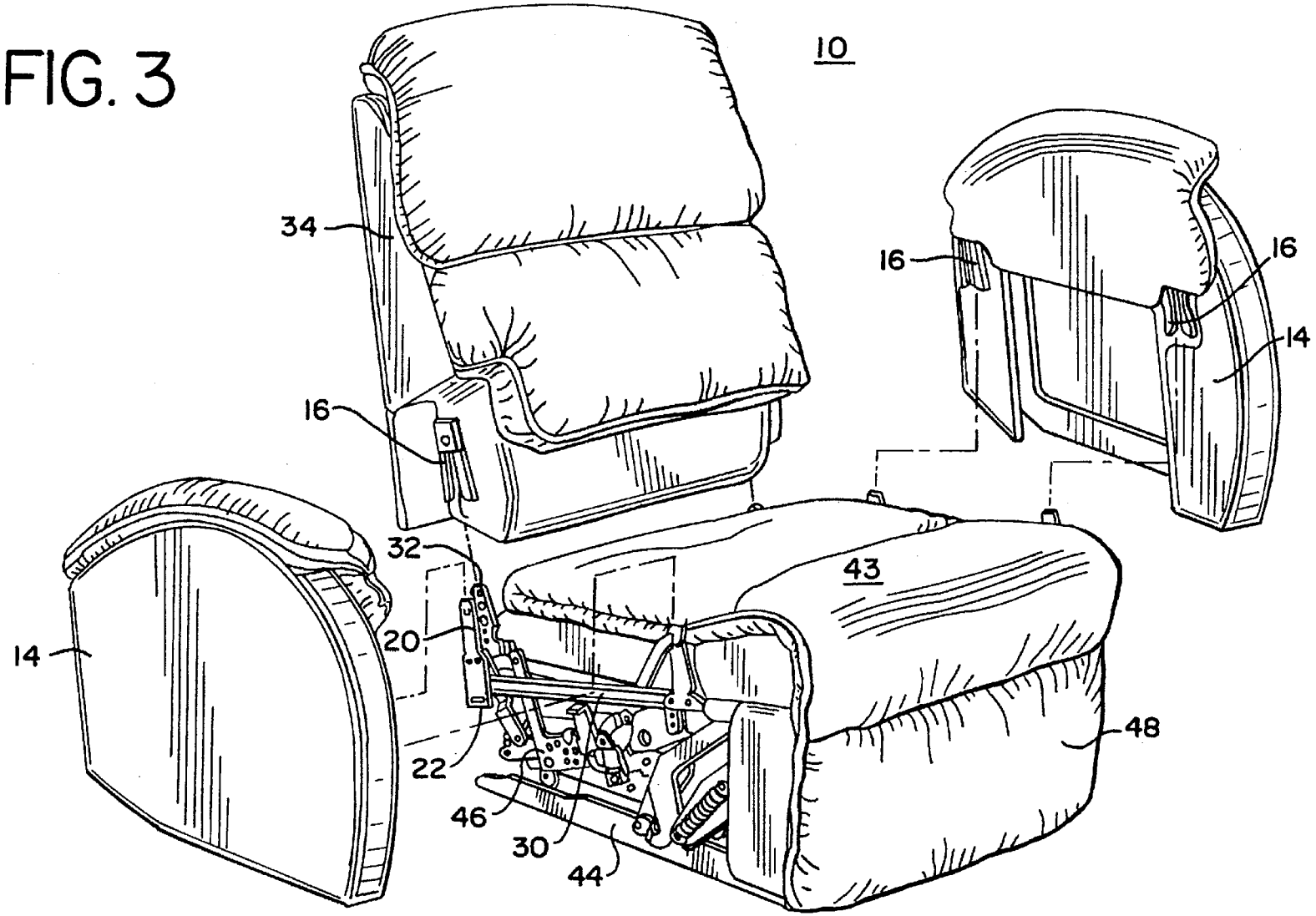
FIG. 3 is an exploded perspective view of the chair showing the arms and seat back detached.
Figure 4:
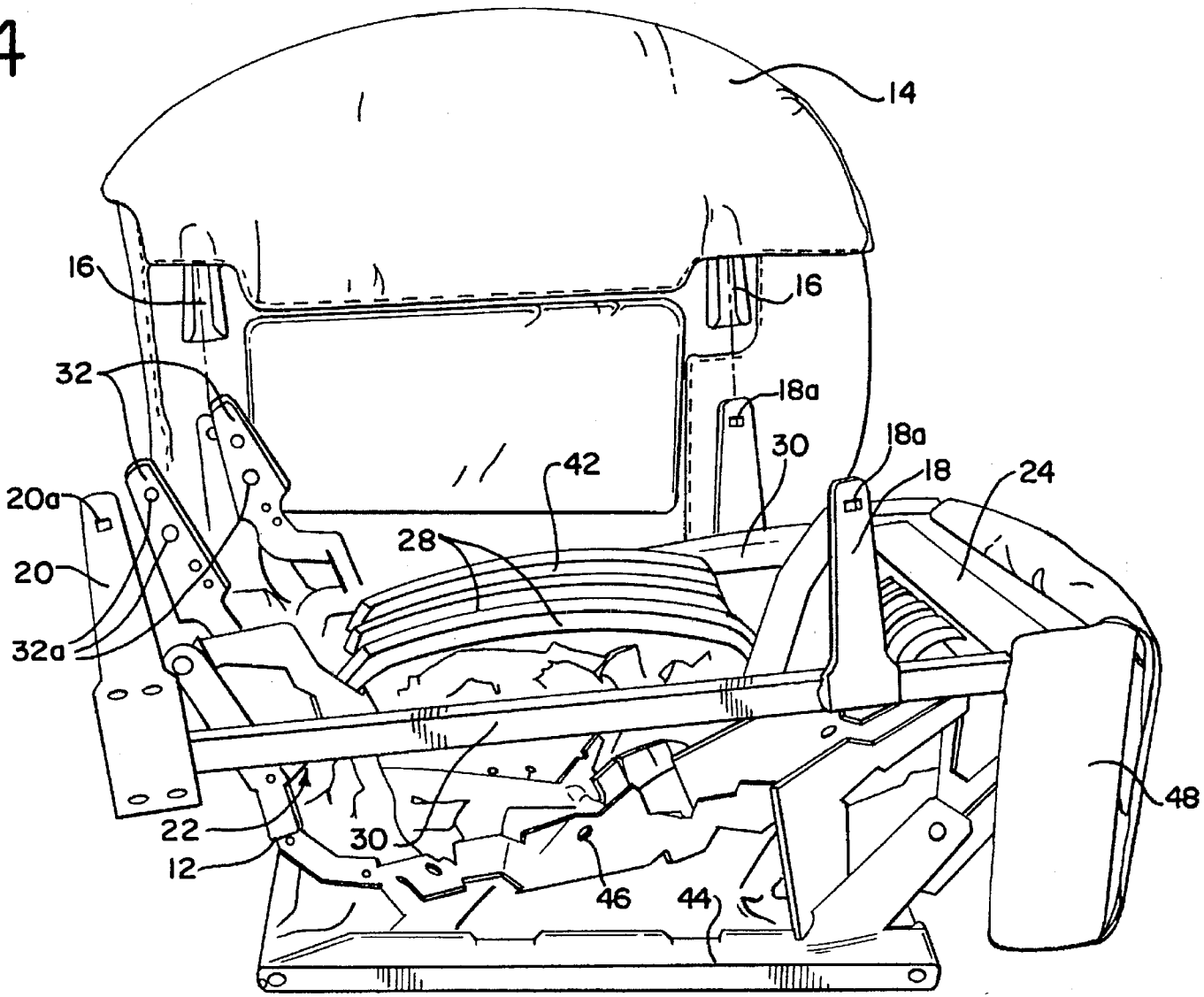
FIG. 4 is a perspective view of the unitized seat spring and frame assembly and attached seat bottom showing a detachable arm in position adjacent to the unitized seat spring and frame assembly to be mounted to the unitized seat spring and frame assembly.
Figure 7:
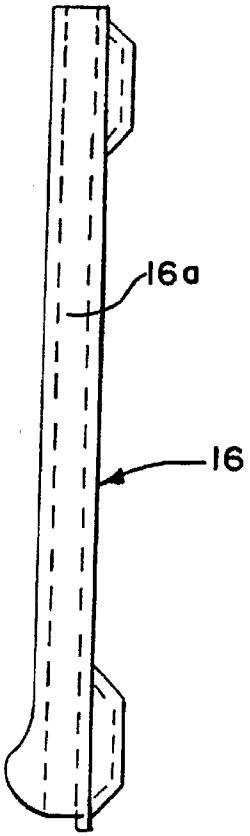
FIG. 7 is a side plan view of a slide bracket.
Figure 6:
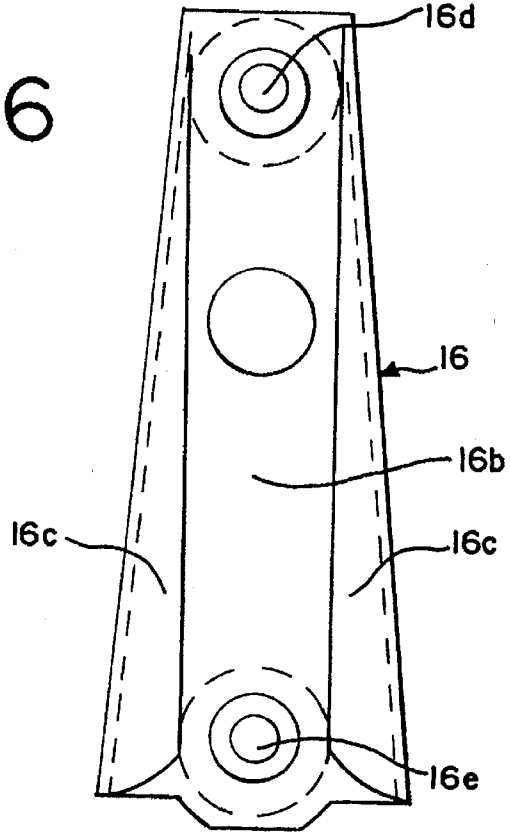
FIG. 6 is a front plan view of a slide bracket.
Figure 8:
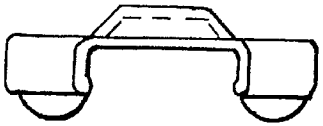
FIG. 8 is a top plan view of a slide bracket.
Figure 10:
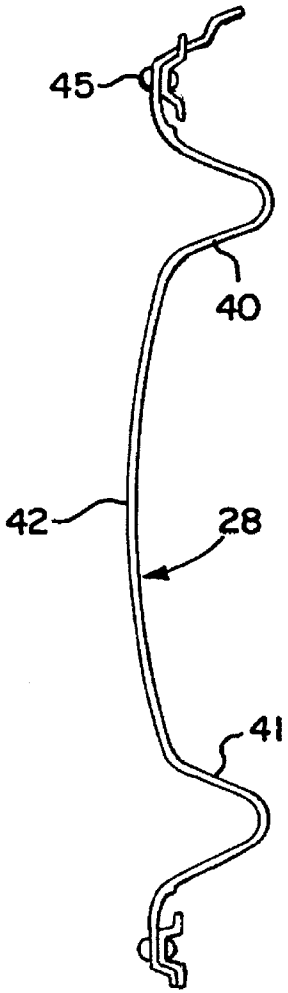
FIG. 10 is a side plan view of a seat spring.

Each one piece arm member 14 includes two attached tapered arm slide brackets 16 as seen in FIGS. 3 and 4. Each slide bracket 16 has a pair of inwardly bent slide bracket flanges **16*a* as seen in FIGS. 6–8. The seat back 34 also has attached a pair of tapered slide brackets 16, having one slide bracket 16 on each side of the seat back 34 as seen in FIGS. 2B and 3. As seen in FIGS. 6–8, the slide brackets 16 are matingly tapered toward its upper end for complementary fitting onto insert brackets 18, 20 and 32. The slide brackets 16 have a shallow channel section comprising a web 16*b*, flanges 16*a*, and inwardly bent lips 16*c*. At the upper end of each slide bracket 16 is a first fastener hole 16*d*. At the bottom end of each slide bracket 16 is a second fastener hole 16*e*. Holes 16*d* and 16*e* are for attaching the slide brackets 16 and 18 to the side of the seat back 34 and to the arm members 14 by, for example, by screws or the like. The slide brackets 16 are matingly tapered toward its upper end for complimentarily fitting onto the insert brackets 18, 20, and 32**.

In one embodiment, the insert brackets 18, 20 and 32 can further include a plurality of holes for facilitating attachment of the insert brackets 18, 20 and 32 to the unitized seat spring and frame assembly 30 and chair recliner mechanism base 46, by for example, screws or the like. Corresponding holes **18*a*, 20*a*, and 32*a* may also exist in the slide brackets 16 for facilitating attachment of the insert brackets 18, 20, and 32 to the slide brackets 16** after insertion of the insert bracket into the slide bracket.

In operation, each arm member 14 is attached to the unitized seat spring and frame assembly 22 by placing the arm members adjacent the sides of the chair 10, and moving the arm downwardly to where the attached slide brackets 16 are slid downwardly over the corresponding insert brackets 18 and 20 attached to the frame. As the arm member 14 moves downwardly, the slide brackets 16 are forced downwardly upon the corresponding insert brackets 18 and 20, so as to thereby wedge the insert brackets 18 and 20 within the channel portion **16*b* of the slide brackets 16 and attach the arm member 14** to the unitized seat spring and frame assembly.

The recliner mechanism base 46 includes mechanical structure for allowing reclining of the seat back and adjustment of the foot rest 48 and is mounted to and between the unitized seat spring and frame assembly 22 and the chair base 44. Similarly, the seat back 34 is attached to the chair 10 by moving the seat back 34 downwardly adjacent the rear of the chair base 49 to where the attached slide brackets 16 are slid downwardly over the corresponding insert bracket 32, thereby, attaching the seat back 34 to the chair base 44.

I claim:

1. A separable chair assembly comprising:

a recliner mechanism base;

a chair base mounted to and beneath said recliner mechanism base;

a pair of detachable arms detachable from said chair base;

said arms being adapted to bear the load conditions imposed by use of the chair;

a detachable back detachable from said recliner mechanism base;

a unitized seat spring and frame assembly having a front portion, a rear portion, and two side members, said unitized seat spring and frame assembly being mounted to said recliner mechanism base, said unitized seat spring and frame assembly also having means for easily attaching and detaching said detachable arms to and from said chair base;

said means for attaching and detaching said detachable arms includes a pair of insert brackets mounted to at least one of said two frame side members, and at least one of two said detachable arms having a corresponding pair of slide brackets mounted thereto, said insert brackets being slidable in said slide brackets; said unitized seat spring and frame assembly further includes a plurality of seat springs mounted thereto, each said spring having a configuration which includes two V-arcs with a central portion between each said V-arc;

said pair of insert brackets further comprises a front bracket and a rear bracket;

said from bracket having a first mounting portion for affixing said bracket to one of said side members;

said rear bracket having a second mounting portion for affixing said bracket to one of said side portions;

said first mounting portion being adapted to welded attachment to said side portion and having a size adapted to the load conditions on the arm at the front portion;

said second mounting portion being adapted to welded attachment to said side portion and having a size adapted to the load conditions on the arm at the rear portion; said detachable back is adapted for mounting on a third pair of brackets whereby both of said arms are removable and said seat back is removable;

said arms being separable and independent from said chair base when detached.

2. A separable chair assembly as in claim 1 wherein said detachable back is adapted for mounting on a third pair of brackets whereby both of said arms are removable and said seat back is removable.

3. A separable recliner seating product assembly comprising:

a seating product base;

a unitized seat spring and frame assembly having a front member, a rear member, and two side members, said unitized seat spring and frame assembly being mounted to said seating product base;

a pair of detachable arms, said arms being detachable from and attachable to said seating product base and when detached, being independent of said seating product base;

two pair of slide brackets, one pair of said slide brackets being mounted to each said detachable arm;

two pair of insert brackets, one pair of insert side brackets being mounted to each said side member, each insert bracket being insertable into one of said slide brackets; and a seat back.

4. A separable seating product assembly as in claim 3 wherein each said side member has a longitudinal track therein, one pair of said insert brackets being mounted in each said longitudinal track.

5. A separable seating product assembly as in claim 3 whereto said unitized seat spring and frame assembly includes a plurality of seat springs mounted thereto, each said seat spring having a configuration which includes two V-arcs and a central portion between each said V-arc.

6. A separable seating product comprising:

a seating product base;

a recliner mechanism base mounted on said seating product base;

a unitized seat spring and frame assembly having a pair of side members, a front member and a rear member, said unitized seat spring and frame assembly being mounted onto said recliner mechanism base;

a seat back mounted to said recliner mechanism base, said seat back having means for easy attachment to and detachment from said recliner mechanism base; and.

a pair of arms mounted to said unitized seat spring and frame assembly, said arms having means for attachment and detachment from said unitized seat spring and frame assembly and said arms being detachable independent from said seating product base.

7. A separable seating product as in claim 6 wherein, said unitized seat spring and frame assembly includes a plurality of springs attached to said unitized seat spring and frame assembly, each said spring having two V-arcs and a central portion in its configuration.

8. A separable seating product as in claim 6 wherein, said seating product includes a foot rest, said foot rest being adjustably attached to said recliner mechanism base.

9. A separable seating product as in claim 6 wherein, said means for attachment and detachment of said arm includes a pair of arm slide brackets being mounted to each said arm and corresponding frame insert brackets being mounted to said unitized seat spring and frame assembly side, said frame insert brackets being slidable in said arm slide brackets.

10. A separable seating product as in claim 9 wherein, said means for attachment and detachment of said seat back includes a pair of seat back slide brackets being mounted to the seat back and corresponding seating product assembly insert brackets being mounted to said recliner mechanism base, said recliner mechanism base insert brackets being slidable in said seat back slide brackets.

* * * * *